US006499914B1

(12) United States Patent
Patout et al.

(10) Patent No.: US 6,499,914 B1
(45) Date of Patent: Dec. 31, 2002

(54) MOVABLE SELF-ELEVATING ARTIFICIAL WORK ISLAND WITH MODULAR HULL

(76) Inventors: Philip J. Patout, 221 Ramblewood Dr., Lafayette, LA (US) 70508; Herman J. Schellstede, 342 Duperier Ave., New Iberia, LA (US) 70563

( * ) Notice: Subject to any disclaimer, the term of this patent is extended or adjusted under 35 U.S.C. 154(b) by 0 days.

(21) Appl. No.: 09/959,175

(22) PCT Filed: Nov. 22, 1999

(86) PCT No.: PCT/US99/27664

§ 371 (c)(1),
(2), (4) Date: Feb. 8, 2000

(87) PCT Pub. No.: WO00/31349

PCT Pub. Date: Jun. 2, 2000

Related U.S. Application Data

(63) Continuation-in-part of application No. 09/198,318, filed on Nov. 23, 1998, now Pat. No. 6,443,659.

(51) Int. Cl.[7] ..... E02B 17/08; B63B 35/44

(52) U.S. Cl. ..... 405/196; 405/195.1; 405/203; 114/265

(58) Field of Search ..... 405/195.1, 196, 405/197, 198, 199, 203, 204; 114/77 R, 264, 265

(56) References Cited

U.S. PATENT DOCUMENTS 3,044,269 A * 7/1962 Tourneau ..... 37/345
3,605,669 A * 9/1971 Yu ..... 114/122
3,805,721 A * 4/1974 Robishaw ..... 114/266
3,965,513 A * 6/1976 Horiuchi ..... 114/352
3,967,457 A * 7/1976 Lovie ..... 254/106
3,999,396 A * 12/1976 Evans ..... 114/77 A
4,056,943 A * 11/1977 Tarrant ..... 405/196
4,256,049 A * 3/1981 Brunet et al. ..... 114/249
4,276,847 A * 7/1981 Ivanov ..... 114/65 R
4,455,109 A * 6/1984 Lorenz ..... 114/288
4,668,127 A * 5/1987 Steele ..... 405/196
5,051,036 A * 9/1991 Gomez De Rosas et al. .... 405/195.1

* cited by examiner

*Primary Examiner*—Gary S. Hartmann
(74) *Attorney, Agent, or Firm*—Jesse D. Lambert

(57) ABSTRACT

A buoyantly moveable, self-elevating (jack-up) artificial work island or platform self-assembled while floating upon a work body of water by reversibly coupling together a plurality of independently buoyant modular hull components (20, 30), each of which is relatively narrow beam and capable of navigation through relatively narrow waterways. After self-assembly, the work platform is self-elevating upon a plurality of legs (51, 52, 53) to a desired distance above the work body of water. The work platform may be buoyantly moved to subsequent work locations as a unit, or separated into modular hull components each of which may be buoyantly moved separately to the subsequent locations. The work platform may further have a drilling derrick, a hoist, drilling fluid pumps, a rotary table and other equipment associated with earthboring for oil and gas installed thereon. The work platform may be elevated above the water surface a sufficient distance to accomodate operational conditions. In one embodiment, additional internal pilings are driven through the legs into the water bottom to provide additional support.

13 Claims, 12 Drawing Sheets

MOVABLE SELF-ELEVATING ARTIFICIAL WORK ISLAND WITH MODULAR HULL

CROSS REFERENCE TO RELATED APPLICATIONS

In the United States, this application is a continuation-in-part application to previously filed U.S. application Ser. No. 09/198,318, of Philip J. Patout, filed Nov. 23, 1998.

This application is a PCT application which is related to previously filed U.S. application Ser. No. 09/198,318, of Philip J. Patout, filed Nov. 23, 1998.

FIELD OF THE INVENTION

The invention disclosed and claimed herein relates generally to movable, self-assembling, self-elevating artificial structures designed to provide a stable, elevated work island or platform from which desired operations may be conducted over water. In certain fields of work, such structures are referred to as "jack-up" rigs or platforms. With more particularity, the invention disclosed and claimed herein relates to a platform composed of a plurality of independently buoyant, modular hull components each of which is navigable through waterways of limited width, depth and/or overhead clearance; each of which is capable of being facilely coupled together with other hull components at desired work locations to form a larger self-elevating work platform; wherein said work platform may be subsequently, either as an integral unit or by disassembly of the modular hull components, buoyantly navigated to other work locations.

DESCRIPTION OF RELATED ART

Particularly in the field of oil and gas exploration and production, "jack-up" structures of various designs are well known. Though such structures have utility beyond oil and gas exploration and production (such as facilities for navigational beacons, weather stations, offshore mooring facilities, and as work platforms from which above-water and underwater construction and/or repairs may be conducted) they are most frequently used for earth boring, and production of fluid minerals from earth bores, located below water of "medium" depth. By water of "medium" depth it should be understood that submersible barges are usually used in very shallow (approximately less than 15 feet) water, "posted barges" in waters of slightly greater depth (approximately less than 25 feet) and various floatable or permanent structures used in deep (approximately over 250 feet) water. It is to be understood, however, that jackup structures (in particular, the structure of the present invention) may be used in waters of very shallow depth, for example on the order of 8 feet deep.

Thus, without limiting the use of jackup structures to other depths, it is in water depths of approximately 8 feet to 250 feet deep, that jack-up structures find their greatest utility. Prior art teaches that such structures consist of a single buoyant hull, a plurality (usually three) of legs, jacking mechanisms that can raise or lower the legs as required and equipment designed to support the operations to be conducted at the work location. Such structures are typically buoyantly navigated on water, typically by tow, to a work location, after which the legs are lowered to the bottom, followed by continued jacking until the hull is a suitable distance (usually called an "air gap") above the surface of the water. Typically from such elevated position desired operations are conducted, and when complete, the jack-up can be re-mobilized by jacking-down until the hull is re-floated, the legs lifted from the bottom and the unit navigated on water, typically by towing, to subsequent work locations.

However, in addition to the depth limitations suggested above, prior art jack-ups have other limitations. If the platform of the jack-up is relatively small, the distance between the legs supporting the platform is relatively small, and such a platform cannot be safely used in deep water (as the jack up is thereby unstable and likely to topple over). If, on the other hand, the platform of the jack-up is large (and therefore the legs can be sufficiently spaced apart to support operations over deeper water) such platform is of substantial beam and thus cannot be moved through narrow waterways to certain bodies of water.

By way of example, one body of water which is more than sufficient size to accommodate large jack-ups, and where such structures are greatly needed for exploration and/or production of oil and gas, is the Caspian Sea. However, such structures cannot be navigated to the Caspian Sea at the present time due to the relatively narrow width, relatively low height and relatively shallow draft limitations of waterways leading thereto. In addition, the shipyard facilities located on the Caspian Sea are inadequate for construction of such structures on-site. Even if such structures were constructed on the Caspian Sea, they could not be quickly or economically moved out of the Caspian Sea through presently existing water ways, should that become necessary.

Accordingly, and the Caspian Sea is but one example, there is a great need for a jack-up structure of substantial size (that is, the horizontal distance between supporting legs is substantial, thereby safely supporting a jack-up in water of substantial depth) which can be brought to a work body of water through relatively narrow waterways leading thereto. Without limitation (because the invention disclosed and claimed herein can also be used in almost any environment where currently existing jack-ups are used) the present invention is directed towards provision of a self-elevating (jack-up) work platform of substantial size, which is comprised of a plurality of modular buoyant components designed to be navigated through waterways of limited width, height and/or draft, and is facilely self-assembling on a work body of water. The design of the present invention also permits its fabrication in a large number of shipyards not having sufficient water depth or width to build a conventional jack-up unit, since the present invention comprising multiple, relatively narrow and shallow draft hull components can be fabricated in shipyards with limited water depth and width capabilities.

SUMMARY OF THE INVENTION

The present invention is directed to a movable, self-elevating (jack-up), artificial work island or platform composed of a plurality of relatively narrow, independently buoyant, modular and self-assembling hull components, each of said hull components capable of independent navigation through relatively narrow waterways and thereafter being facilely coupled together at a work location to form a larger, self-elevating, work platform. Said invention is primarily characterized as comprising a plurality of modular hull components designed to be coupled together at a work location to form a larger self-elevating work platform. Each modular hull component is independently buoyant and is therefore capable of navigating, typically under tow, as a separate vessel. Said hull components are of narrow beam so that they may be buoyantly navigated through narrow waterways. Said hull components are preferably elongated (having a length in excess of their narrow beam) so as to minimize the number of hull components required to form a work platform of desired size, and to maximize the distance between the legs supporting the assembled work platform. They may also be of relatively low height and of shallow draft where overhead clearances and depth of the narrow waterways are also limited.

When reaching a work location, the modular hull components are designed to be self-assembling (facilely coupled together on a work body of water) to form a work platform having a substantially larger beam than the individual hull components. After assembly, typical leg means and jacking means are employed to elevate and lower the assembled work island as desired. The assembled work platform is itself buoyant and may be moved to subsequent work locations over waters sufficient to accommodate the beams of the assembled work platform. Coupling of the individual hull components together may be facilely reversible or substantially permanent. Whatever means of coupling and assembly is employed, the modular hull components of the work platform may be facilely and economically de-coupled, on the work body of water, and subsequently navigated as independent modules through either narrow waterways or over open water.

OBJECTS OF THE INVENTION

The principal object of the present invention is to provide an improved mobile, self-elevating work island or platform. More particularly an object of the invention is to provide a mobile, self-elevating work island composed of a plurality of assembled modular hull components each of which is of narrow beam, is independently buoyant, and is therefore capable of being independently navigated, as a vessel, typically by tow, through relatively narrow waterways. Another object of the invention is to provide a plurality of independently buoyant modular hull components which are capable of being interconnected with other hull components to form a work platform which is larger than said modular hull components. Yet another object of the invention is to provide an assembled self-elevating work platform which is itself capable of being buoyantly navigated as an integral unit, typically by tow, over waters of sufficient width to accommodate the beam of the assembled work platform.

A platform composed of narrow hull components which is, while disassembled, capable of being navigated through narrow waterways, forms another object of the invention. An artificial work island composed of such hull components may also be, while disassembled, more facilely navigated over open water than a typical work platform (of substantial beam and roughly equal length); therefore yet another object of the invention is to provide for such a work platform. Another object is to provide a work platform which, when disassembled, may be efficiently transported over waterbodies on heavy lift vessels or "dry tow" vessels.

DESCRIPTION OF THE PRESENTLY PREFERRED EMBODIMENTS OF THE PRESENT INVENTION

While the present invention will herein be described with reference to preferred embodiments thereof, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed, but that the invention will include all embodiments (and legal equivalents thereof) falling within the scope of the appended claims.

In particular it should be understood that although the preferred embodiment of the present invention primarily concerns itself with a self-elevating work platform which is fitted with a derrick, crane and other components typically used in offshore earthboring operations associated with exploration for oil and gas, and the invention does comprehend such adaptation, the invention is not limited to such adaptation, and may be adapted to many other over-water operations, including but not limited to, a platform for navigational beacons, meteorological stations, offshore mooring and/or unloading or loading facilities, work platforms from which offshore construction and/or diving operations may be conducted and other operations where a movable work platform may be useful.

Figure 1:
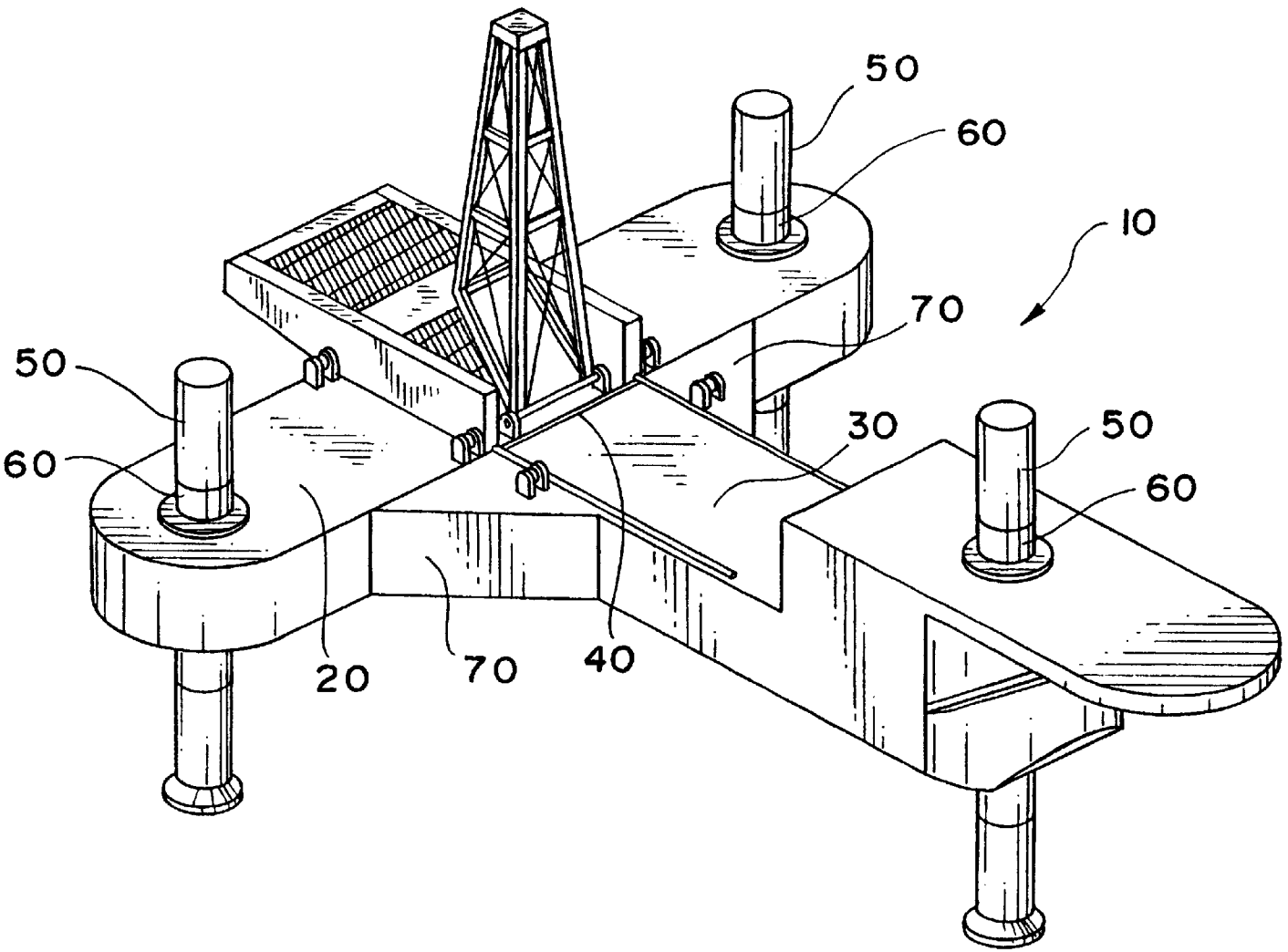
FIG. 1 is an isometric perspective of the principal components of one of the preferred embodiments of the present invention.
Figures 2, 3:
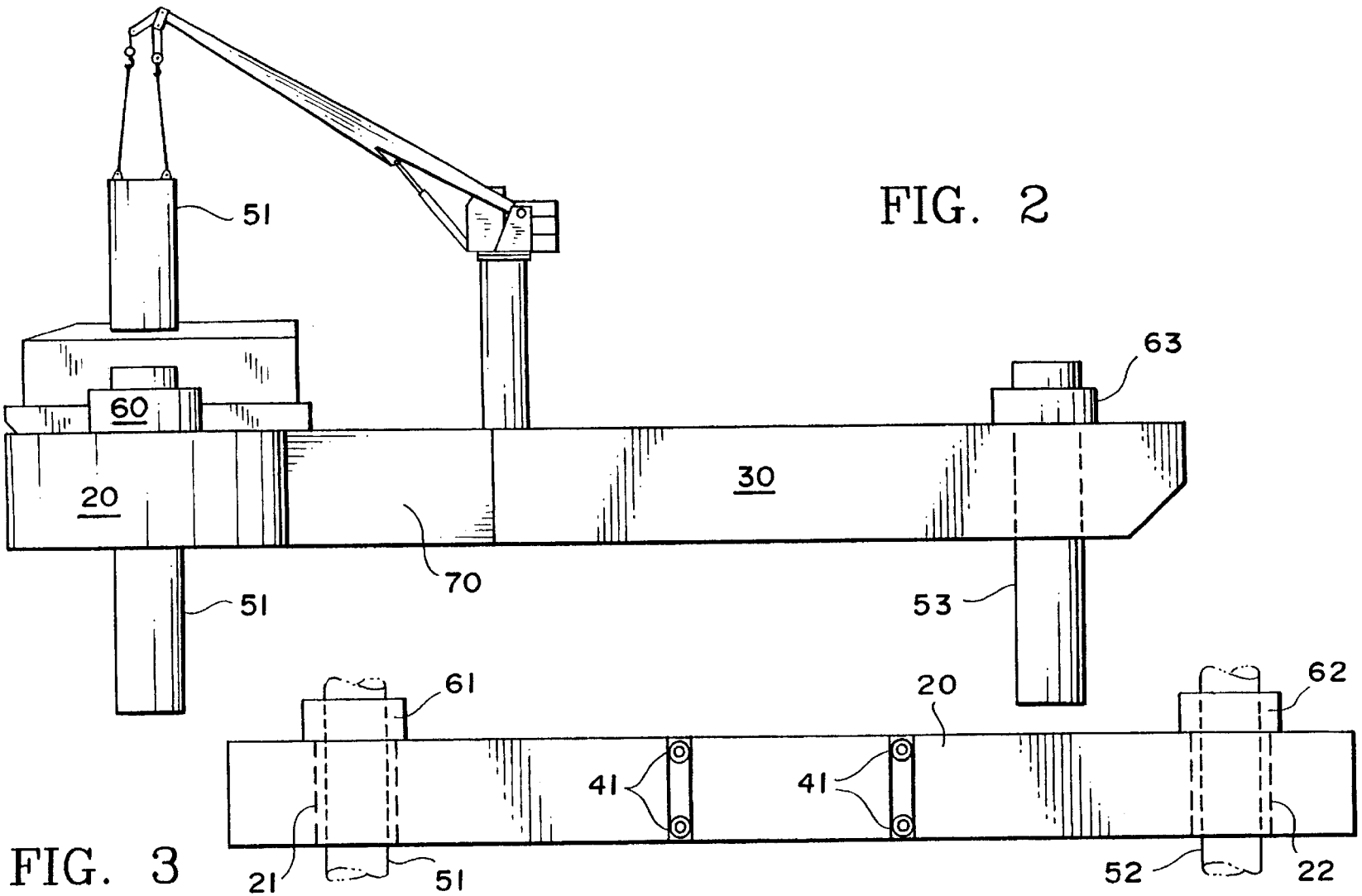
FIG. 2 is a side view showing an extension being added to one leg thereof.
FIG. 3 is a side view of the first hull component of one embodiment of the present invention.

FIG. 1 illustrates one of the preferred embodiments of the assembled self-elevating work platform 10 of the present invention. Work platform 10 is principally characterized by a plurality (at least two) of independently buoyant modular hull components, 20 and 30, which are (when assembled) coupled together at joint 40. Work platform 10 is also characterized by a plurality (at least three) of legs, generally designated collectively in FIG. 1 as legs 50 (and referred to in more detail hereafter as legs, 51, 52, and 53, as will be described). Jacks, referred to collectively as element 60 in FIG. 1 (and referred to in more detail hereafter as jacks, 61, 62, and 63), as will be described, may be used to move legs 50 upwardly and downwardly in relation to work platform 10. FIG. 2 is a side view of the assembled invention.

Figure 4:
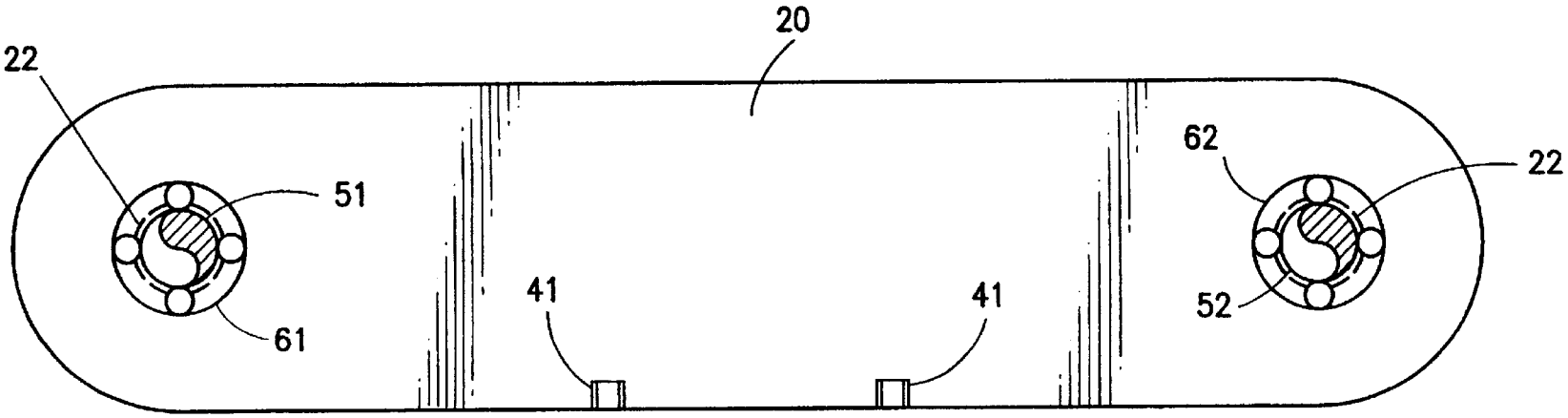
FIG. 4 is an overhead view of the first hull component.

Illustrated in FIG. 3 is a side view of one preferred embodiment of hull component 20. FIG. 4 is an overhead view of the same hull component 20. Modular hull component 20 is designed from the onset to be independently buoyant and therefore capable of independent navigation as a vessel, typically by towing, over navigable waters of sufficient depth to accommodate its draft. In a preferred embodiment of the invention which is directed to assembly of a three legged work platform suitable for oil and gas drilling operations, hull component 20 will typically be constructed of a beam framework (typically of metal beams) covered with sheet metal (also typically metal). In such embodiment of the invention, hull component 20 will be generally elongated, and have a beam at least slightly less than the narrowest point on the narrowest waterway which it is expected to traverse to reach the locations where work platform 10, when assembled, will be expected to work. Hull component 20 is equipped with two water-tight, sleeved hull penetrations, 21 and 22, disposed proximate the ends of hull component 20, through which two of the legs of the platform, 51 and 52, are slidably disposed. Hull component 20 is also equipped with jacks 61 and 62 which move legs 51 and 52 upwardly and downwardly as desired.

In the preferred embodiment of the invention, hull component 20 is also equipped with means for facilely and reversibly coupling hull component 20 to hull component 30. As depicted in FIGS. 3 and 4 such means are comprised of four female receptacles 41 of a breech-lock type coupling mechanism. However, various other means for coupling hull components 20 and 30 may also be employed. Alternatively each hull component might be coupled together by clevis and pin arrangements.

Yet another presently preferred alternative embodiment, as will be described in further detail below, is formed by overlapping or cantilevering a portion of one hull component over the other hull component, and pinning the hull components one to the other.

In practice and as a safety measure, it will generally be desirable to employ more than one means of coupling the hull components together, one means constituting a back-up in case the other fails. Alternatively hull components 20 and 30 may be joined by welding them together on the work body of water. Whatever coupling means is used should be very strongly attached to load bearing structural members of both hull components, so as to provide a strong, rigid means of interconnection of hull components.

Figure 5:
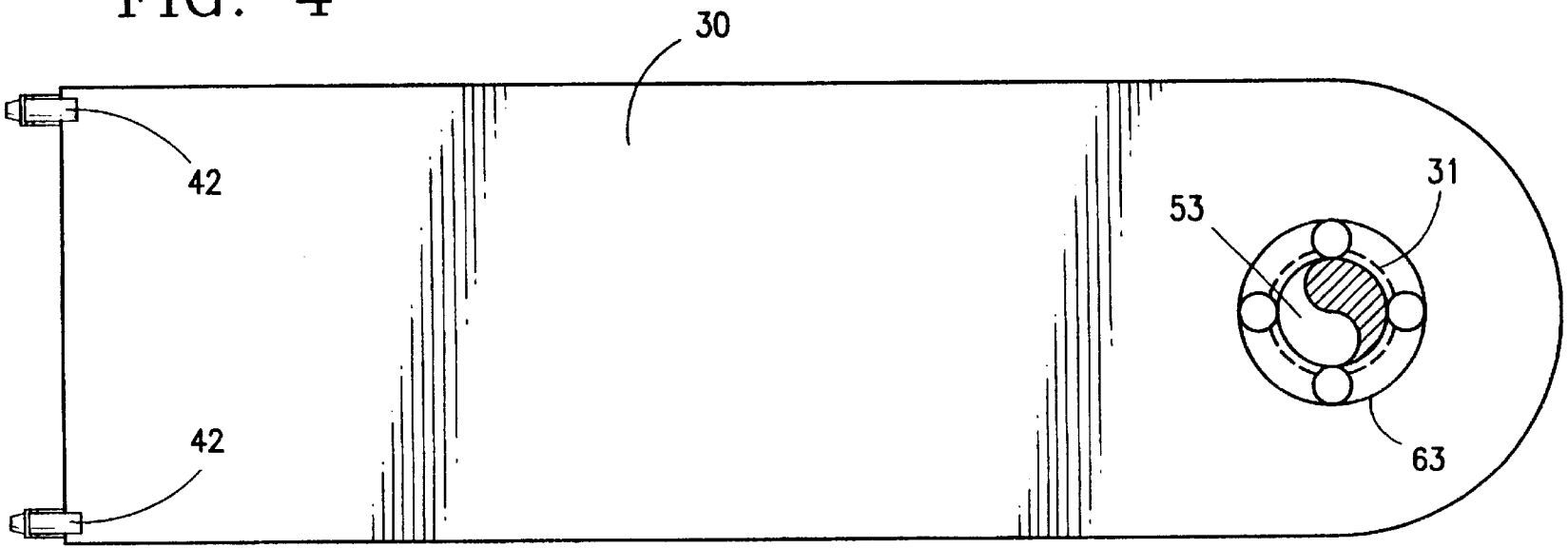
FIG. 5 is an overhead view of the second hull component of one embodiment of the present invention.
Figure 6:
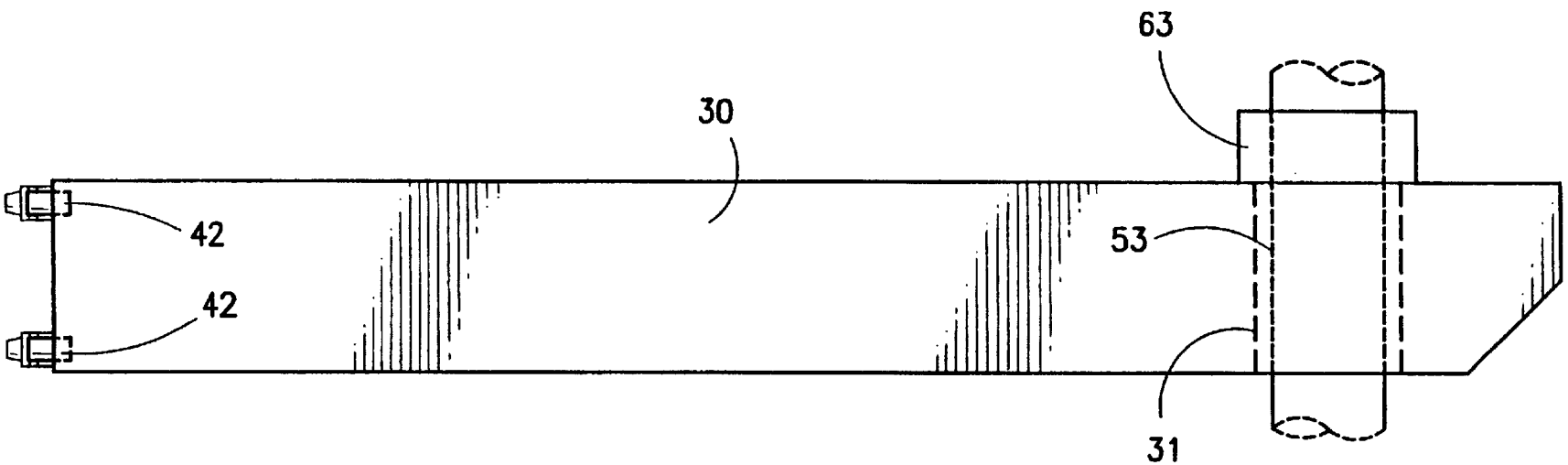
FIG. 6 is a side view of the second hull component of the present invention.

Now referring particularly to FIGS. 5 and 6, second hull component 30 is also preferably of metal frame and sheet metal construction. As is the case with hull component 20, hull component 30 is designed from the onset to be independently buoyant thus capable of independent navigation, as a vessel, over navigable waters sufficiently large and deep to accommodate it. Accordingly it will also have a beam at least slightly less than the narrowest point on the narrowest waterway which it must traverse enroute to desired work locations.

Although in the illustrated embodiment, hull components 20 and 30 are generally elongated, and may have length to beam ratios of (by way of example only) from two to eight, it is understood that the present invention encompasses other possible hull component shapes and relative length to width ratios, such as full or truncated triangles, squares, parts of ellipses, and the like.

Figure 7:
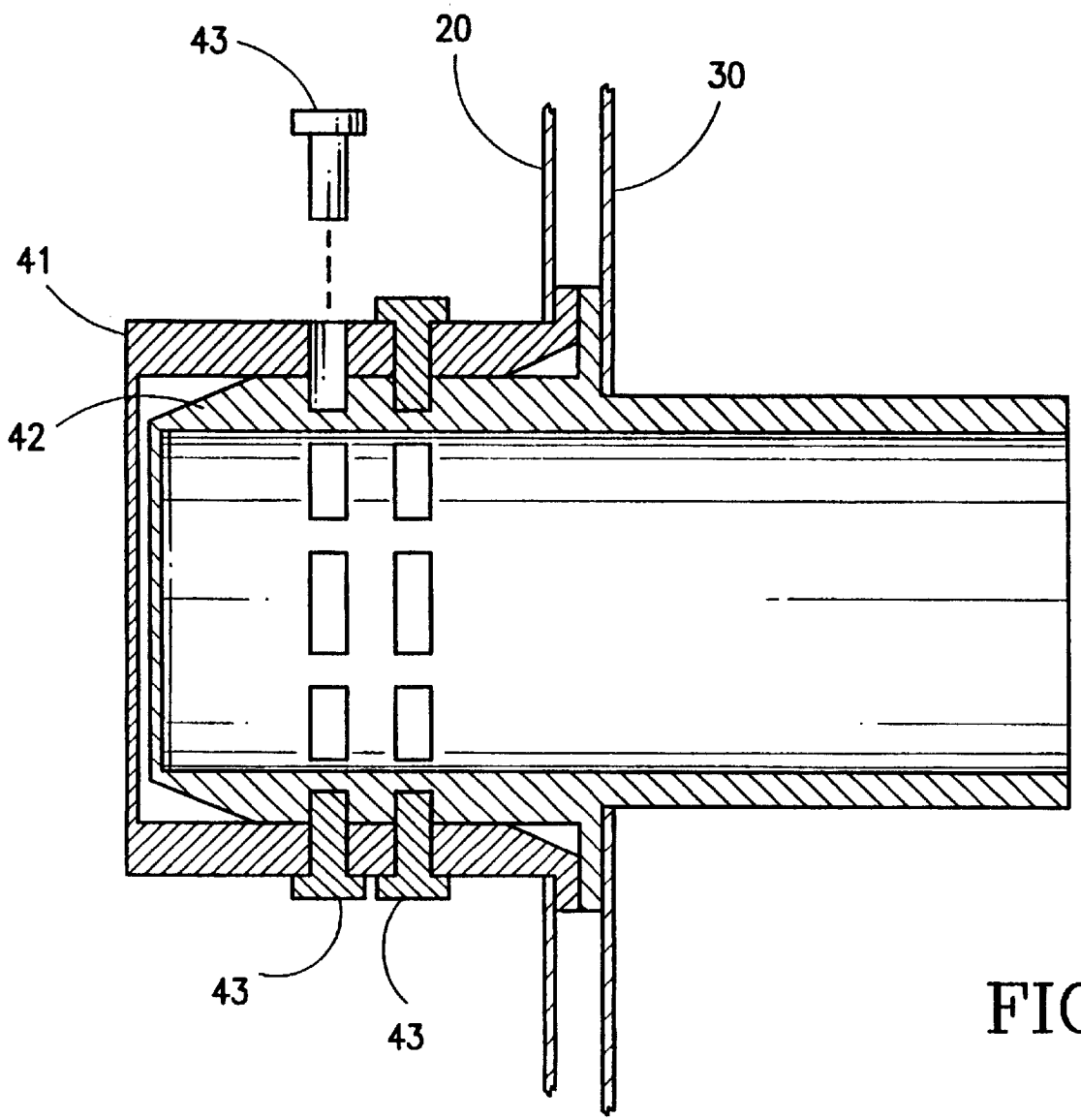
FIG. 7 is a detailed view of the coupling components of one embodiment of the present invention.

As further depicted in FIG. 5 and 6 one end of hull component 30 has male couplings 42 designed to mate with female receptacles 41 disposed on hull component 20, so that, in one referred embodiment the end of hull component 30 may be coupled perpendicularly to the side of hull component 20, generally forming a "T" shaped work platform as shown. As depicted in FIGS. 5 and 6, in that embodiment, male couplings 42 are comprised of four male projections of a breech-lock type connector which mate with the four female receptacles 41 of hull component 20. FIG. 7 shows the connector in detail. After mating of the breech lock connectors by male couplings 42 within female receptacles 41, locking pins 43, shown in FIG. 7, would typically be inserted to secure said connection. Alternative couplings may be used on hull component 30 so long as they are designed and disposed so as to strongly mate with hull component 20 when hull components 20 and 30 are in desired position.

Hull component 30 also has a water-tight, sleeved hull penetration 31 disposed proximate to the end of hull component 30 which is opposite male couplings 42, with leg 53 passing through sleeved hull penetration 31. Accordingly, when hull components 20 and 30 are perpendicularly interconnected, as shown in FIG. 1, work platform 10, comprising a plurality of interconnected hull components, is supported by three legs, 51, 52 and 53 which are widely separated horizontally. So disposed the platform is stable in relatively deep water. Jack 63 is employed to move leg 53 upwardly and downwardly as desired.

Figure 9:
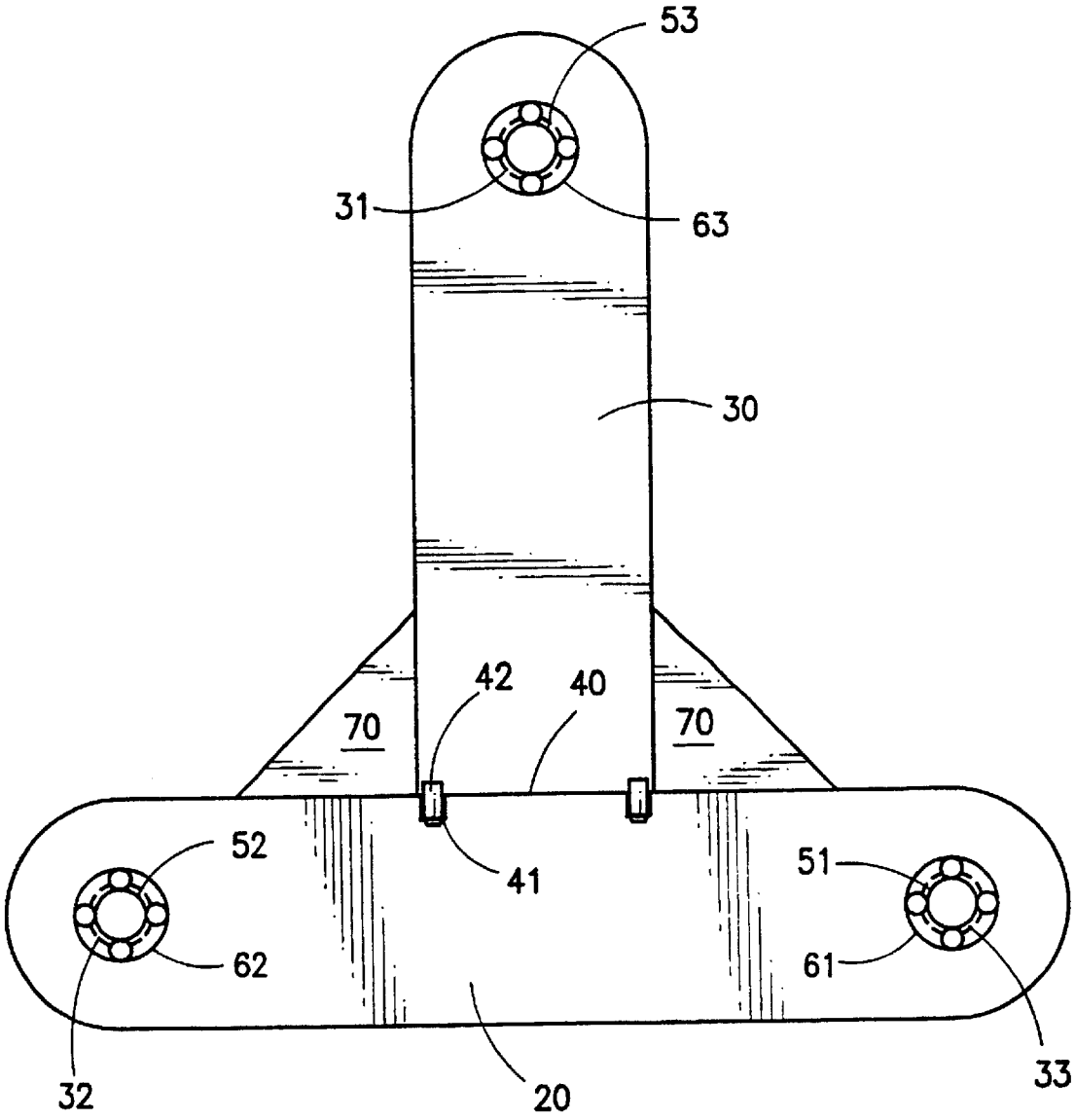
FIG. 9 is an overhead view of the two hull components of the present invention in proximate relation to each other and being coupled together.

If necessary, flashings 70, shown in FIGS. 1 and 9, may be employed to increase lateral load bearing capability of the work platform, add buoyancy to the work platform, and/or increase available deck space. Flashings 70 are typically removable and would typically be removed during navigation of the hull components through narrow waterways. Flashings 70 may be attached by a male/female connector as described above, or alternatively by bolting, welding or other means well known in the art. While different configurations of flashings 70 are possible, in a presently preferred embodiment flashings 70 would have a height substantially the height of the hull components, and would be fabricated of a water-tight sheet metal skin over structural beams. It is understood that shapes and dimensions of flashings 70 may be altered to suit particular circumstances.

Before being dispatched to a work location, hull components 20 and 30 will typically be equipped with various appurtenances directed towards the accomplishing the desired work once the modular hull components are navigated to the work body of water, self-assembled on and self-elevated above said work body. For instance in the case of a work platform which is intended to accomplish drilling for oil and gas, each of the modular hull components would have various appurtenances directed to accomplish such operations installed thereon. For instance, in the preferred embodiment of the invention as a drilling or workover rig, a derrick (or mast), hoisting equipment, rotary turntable and pumps, and lines and tanks for handling drilling fluids would typically be installed on one or the other of said modular hull components. Likewise, living quarters, a crane and a helipad may be installed on one or the other of said modular hull components.

By utilization of appurtenances having certain design characteristics, the height of each modular hull component and the equipment thereon can be controlled to allow passage of each of said modular hull components through waterways which not only have a narrow width, but have height and draft restrictions. For instance, a mast of a "lay down" design will be typically used. Likewise, to accommodate height restrictions, it is possible that only a partial length of the legs will be installed before transit to the work body of water. Additional sections will usually be added (via welding or other suitable means), as shown in FIG. 2, after coupling of the modular hull components on the work body of water and elevating it at least slightly in order to stabilize the platform.

Similarly, projections below the modular hull components will typically be avoided prior to arrival on the work body of water so as to limit the draft of said modular hull components. Therefore the legs of the work platform will typically be retracted so as to be substantially flush with the bottom of said modular hull components during transit.

Accordingly due to the modular nature of the components of the work platform of the present invention, it will be possible to bring a work platform of a relatively large size when assembled to a work body of water, through waterways leading thereto which may be limited in width, height and depth.

It will also be advantageous to "modularize" various utilities or services which may be necessary for each of the modular hull components to have. For instance, on a rig which is used in drilling for oil and gas it is likely that both of the modular hull components will need a supply of electricity, potable water, non-potable water, hydraulic pressure, air pressure and possibly drilling fluid lines. Yet it would not be economical to provide each module with an independent source of each of these utilities or services. In such case it is preferred that there would be only one supply for each of these services or utilities, but lines for connecting such utilities to the other hull component be provided at or near the area the hull components are designed to mechanically interconnect. In this fashion it will be relatively facile to provide the entire platform with common sources for said utilities and services.

As will be obvious to those skilled in the art, more than two hull components may be coupled together if necessary to provide a work platform of a desired size, and said hull components need not necessarily be coupled together in perpendicular relationship, but may be coupled side to side or even at various angles (other than at right angles) if necessary. Those skilled in the art will also recognize that while the invention disclosed herein comprehends a minimum of three legs which will support the assembled platform, if necessary more than three legs may be employed and disposed at proper position in whichever hull component may be appropriate.

Figure 8:
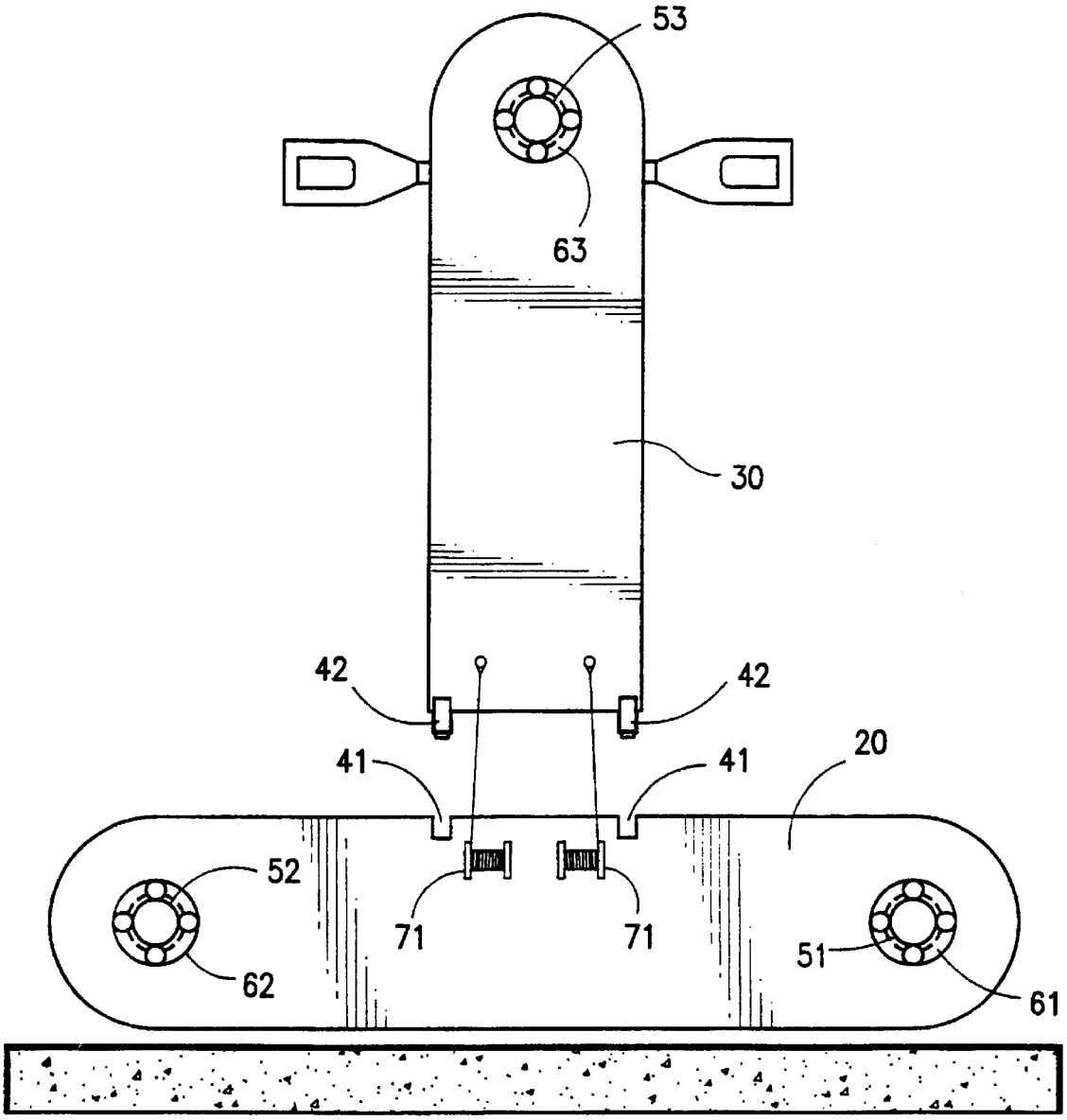
FIG. 8 is an overhead view of two hull components of the present invention being drawn together by cable winches.

The preferred method of constructing or assembling the components of the present invention is initiated with pre-installing equipment onto hull components 20 and 30 at a shoreside facility. Thereafter, both hull components 20 and 30, along with at least a portion of legs 51, 52 and 53 in place and retracted, are independently transported to a first work site. Upon reaching said work site, hull components 20 and 30 are positioned so that couplings 41 and 42 can be interlocked, as shown in FIGS. 7 through 9. In the preferred embodiment, as shown in FIG. 8, cable winches 71 and hydraulic jacks are used to tightly draw hull components 20 and 30, and thereby couplings 41 and 42, together. After being drawn tightly together 41 and 42 will be locked together by pins 43. After hull components 20 and 30 are interconnected and forming a unitary work platform 10, jacks 61, 62 and 63 are respectively used to lower legs 51, 52 and 53 until they rest on the marine floor. If necessary, additional length can be added to the legs at this time, typically by welding to the upper ends thereof. Jacks 61, 62 and 63 are then typically operated further (jacking said legs down) until the work platform is elevated a desired distance, usually called an "air gap", above the surface of the water. Typically after said air gap is established, the work that the platform was designed to accomplish at the work location (for instance drilling operations) is commenced. Although a dock is shown in FIG. 8 adjacent hull component 20, such dock facility is not necessary in many instances.

Under certain conditions a larger than normal air gap is necessary. For example, the work platform of the present invention may be employed on water bodies having significant ice formation, and thereafter ice flows, in particular where the ice flows have a significant "sail area" extending above the waterline. Such ice flows may be high enough to require a higher than normal air gaps, and the work platform of the present invention may be jacked up accordingly. However, at large air gaps, and with ice flows moving against jack-up legs, leg stresses are increased. To provide additional stiffening, internal pilings may be driven through the legs into the water bottom. In this embodiment of the present invention, shown in FIG. 9*a*, an additional internal piling 80 is driven through leg 51 to a desired distance below water bottom 75. Leg 51 may further comprise a plurality of centering rings 51 a disposed therein, to provide a guide for internal piling 80. In similar manner, the remaining legs of the work platform may have internal pilings therethrough (in FIG. 9*a*, only one leg 51 and a partial cross section of hull component 20 are shown).

Once operations are completed at the first work site, mobile, self-elevating work platform 10 can be remobilized by substantially reversing the above described procedure. Work platform 10 is jacked down to the marine surface until buoyancy of the work platform is reestablished. Further jacking upward thereafter, possibly in conjunction with conventional jetting of the leg bottoms, elevates the legs from the marine floor and permits the work platform to be moved as a unitary structure to subsequent work locations. Alternatively, if desired, hull components 20 and 30 may be de-coupled and independently moved to subsequent locations, if necessary through waterways of limited width, depth or having obstructions which limited the height of vessels passing therethrough.

The design of the self-elevating work platform of the present invention (with the ability to retract legs) permits its transit (and employment, if need be) through very shallow water, in depths on the order of 8 feet, and use in medium depth waters, without limitation up to 250 feet deep. It is to be understood that design changes may be made within the spirit and scope of the present invention to permit its use in shallower and deeper waters.

Figure 10:
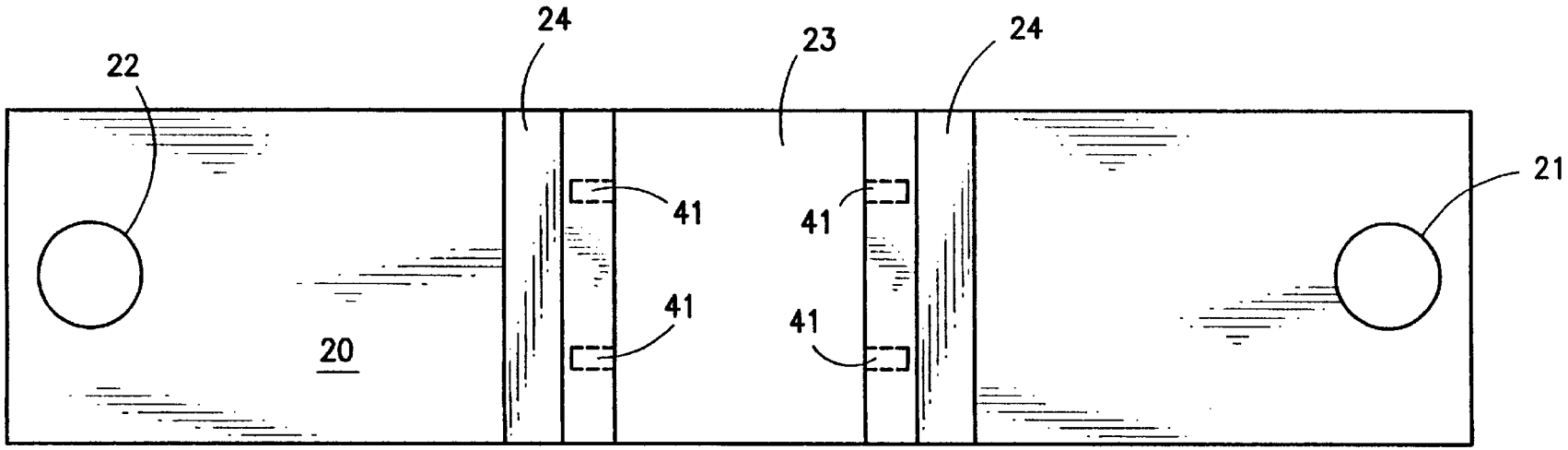
FIG. 10 is an overhead view of another preferred embodiment of a first hull component of the present invention.
Figure 11:
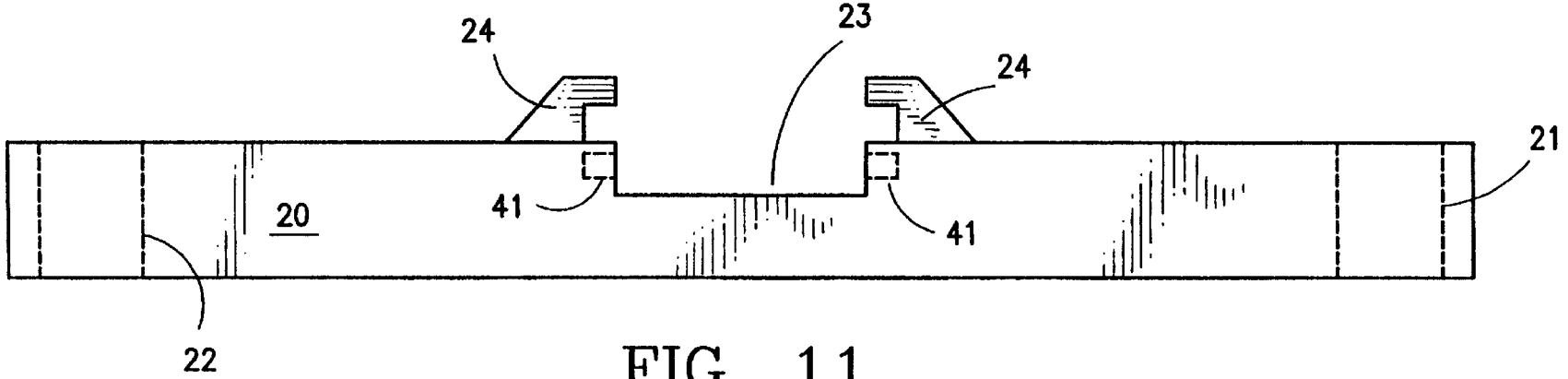
FIG. 11 is a side view of the first hull component of FIG. 10.

Yet another presently preferred embodiment of the present invention is shown in FIGS. 10 through 14. In that embodiment, hull components 20 and 30 are connected together in an overlapping or cantilever relationship to form work platform 10. In the ensuing description, to the extent possible, like element numbers are numbered consistent with the earlier described embodiments. Referring to FIGS. 10 and 11, hull element 20 comprises a pair of sleeved hull penetrations 21 and 22 through which legs 51 and 52 (not shown for clarity) pass. Hull component 20 further comprises a keyway 23 and a pair of guide members 24 disposed alongside keyway 23.

Figure 12:
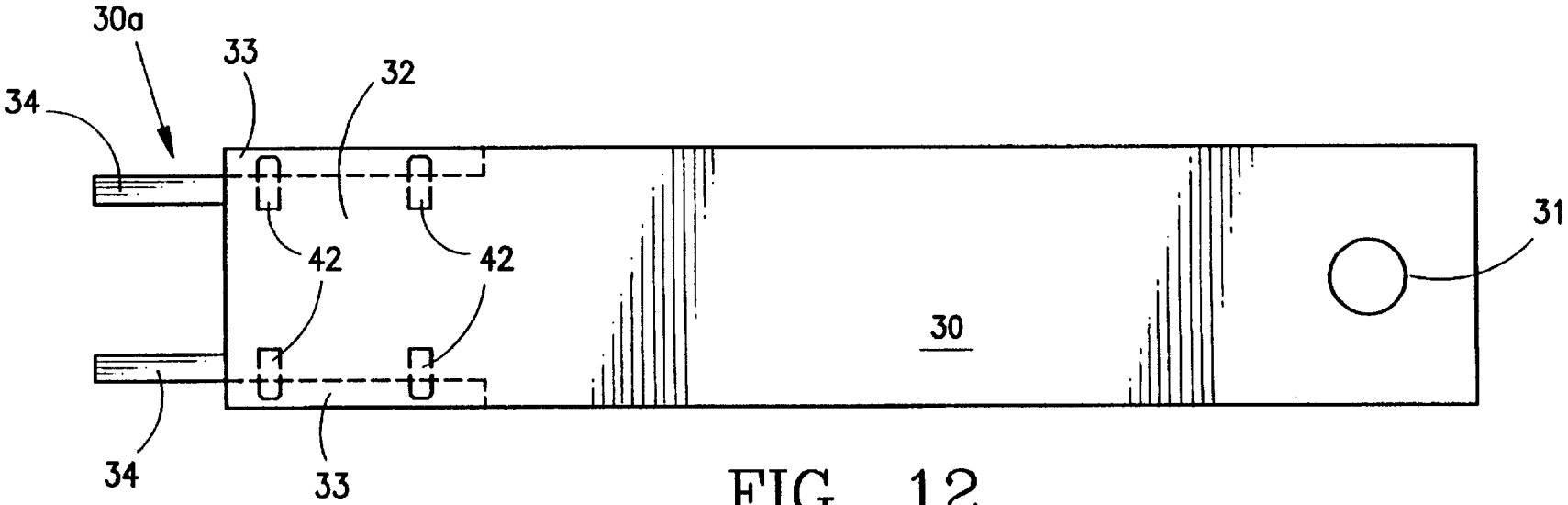
FIG. 12 is an overhead view of another preferred embodiment of a second hull component of the present invention.
Figure 13:
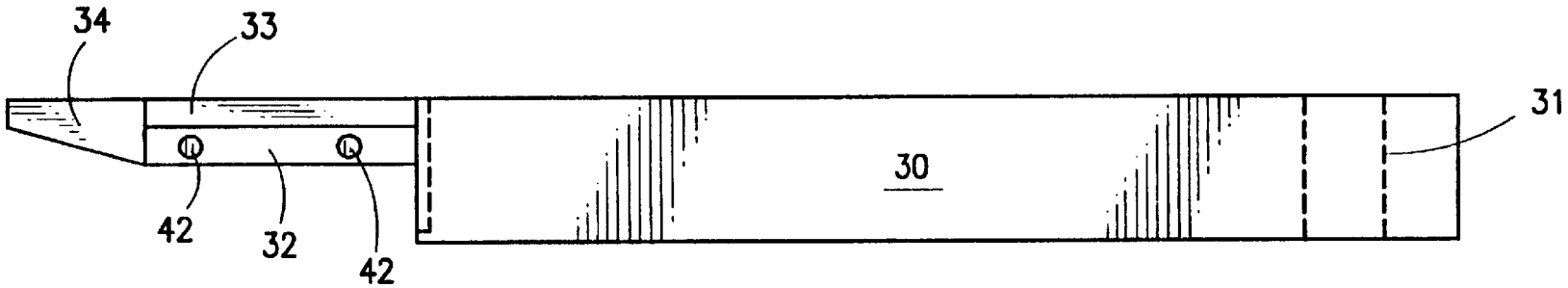
FIG. 13 is a side view of the second hull component of FIG. 12.

FIGS. 12 and 13 show hull component 30 of this embodiment. As in the earlier described embodiments, hull component 30 comprises a sleeved hull penetration 31 for passage of leg 53 (not shown for clarity) therethrough. Hull element 30 further has a male key assembly, generally denoted 30*a*, comprising a pair of rails 34 to aid in stabbing male key assembly 30*a* into keyway 23 (and to form a cantilever support for a drilling rig package, as hereinafter described), and an interlocking section comprising arm 32 and overhanging flanges 33. The cross section shape of male key assembly 30*a* formed by arm 32 and flanges 33 is adapted to fit closely within the cross section shape formed by keyway 23 and guide members 24. Hull component 30 further comprises male couplings 42, as shown, to positively connect hull components 20 and 30. In this embodiment, male couplings 42, which may be four in number (although a greater or lesser number may be used), comprise retractable male pins which may be moved into and out of hull component 30 by appropriate drive means. When male couplings 42 are retracted, male key assembly 30*a* may be readily stabbed into the area formed by keyway 23 and guide members 24. Thereafter, male couplings 42 are extended so as to enter female connectors 41 on hull component 20, thereby bolting together hull components 20 and 30.

Figure 14:
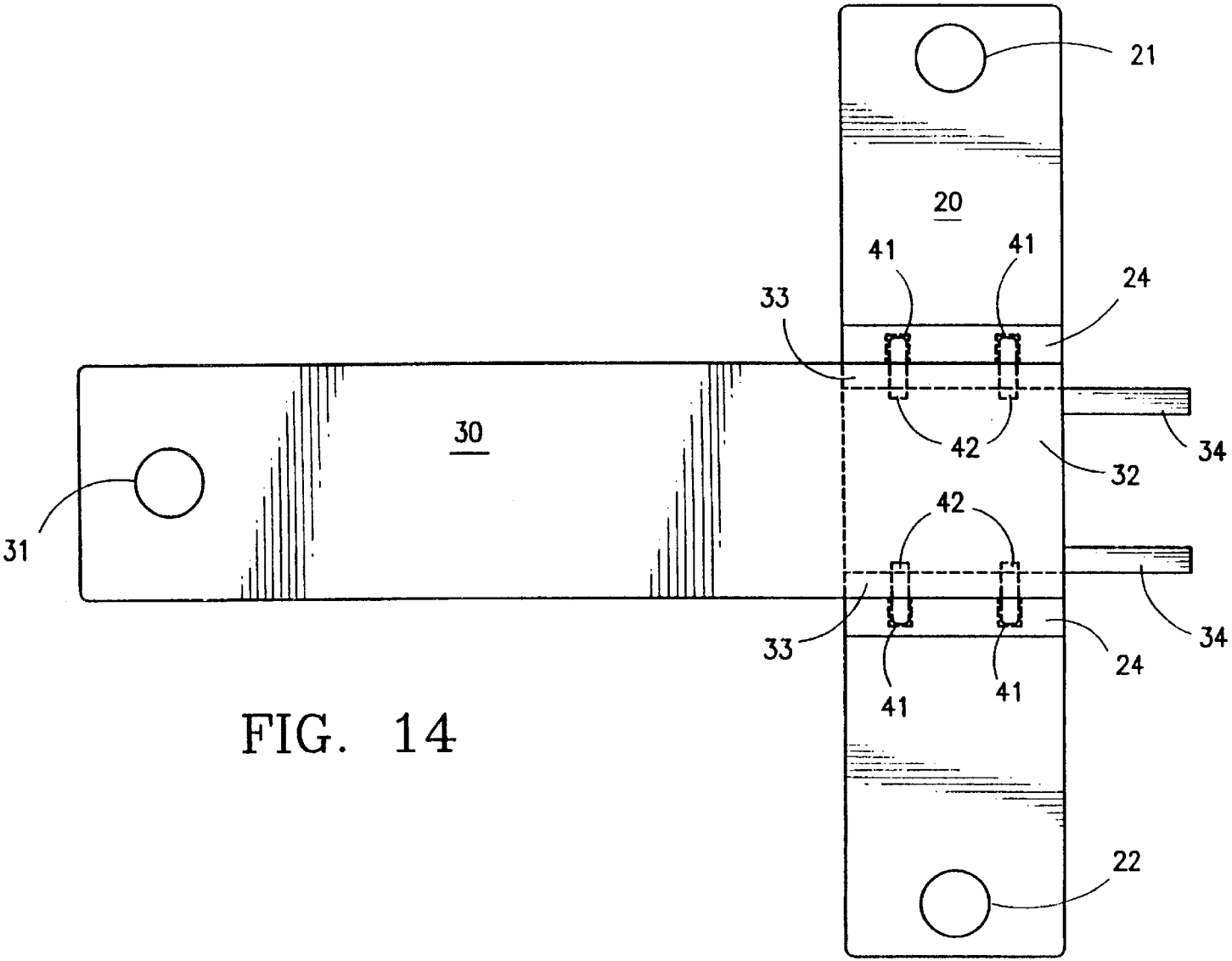
FIG. 14 is an overhead view of the first and second hull components of the embodiments shown in FIGS. 10 through 13, connected together to form a work platform.

FIG. 14 shows the hull components 20 and 30 of the embodiment of FIGS. 10 through 13, connected to form the self-elevating work platform of the present invention. Similar to the coupling process described for the earlier embodiments, hull components 20 and 30 may be floated into position for stabbing together, with the two hull components generally at right angles to one another and the male key section 30*a* aligned with keyway 23. Then, the two hull components may be brought together by suitable means (such as the cable and winch apparatus shown in FIG. 8), with rails 34 first entering keyway 23, then arm 32 and flanges 33 entering the area formed by keyway 23 and guide members 24 until the two hull components are fully engaged, as shown in FIG. 14. Male connectors 42 are then extended outwardly from hull component 30 into female receptacles 41 in hull component 20, to form a strong connection between the two hull elements 20 and 30. It is understood that other embodiments of coupling are possible, including welding, pin and clevis, bolting, and other means known in the art.

As will be readily understood by the description, the embodiment shown in FIGS. 10 through 14 and described herein, comprising an interlocking, overlapping, cantilevered joint between the hull components, which is then further coupled together by connectors, makes a very strong and secure connection between the hull components. It is understood that many different changes can be made without departing from the scope of the invention of this embodiment. For example, the cross-section shapes and dimensions of keyway 23, guide members 24, and the male key assembly 30*a* may be varied to suit particular purposes. Rails 34 may be of different shapes and dimensions. Hull elements 20 and 30, while generally joined in substantially perpendicular relationship to form a "T" shape when viewed from overhead, may be joined at angles other than 90 degrees, and the hull components may vary in number, shapes, and dimensions. As for the earlier-described embodiments of the present invention, the sequences of disconnecting the hull elements; jacking up the work platform on location and jacking same down in preparation for moving are similar. Likewise, the hull components may be connected in different manners, such as bolting, welding, or a variety of other secure methods well known in the art. In addition, that portion of rails 34 extending beyond hull component 20 may support a drilling rig package (not shown). Typically, such a package may rest on skid beams in turn resting on said rails, so that the rig package may be skidded from a first, retracted position (which may be substantially centered over the overlapping sections of hull components 20 and 30) to a second, cantilevered position toward the ends of rails 34. In such a second position, the rig package is thereby suspended over water.

Figure 15:
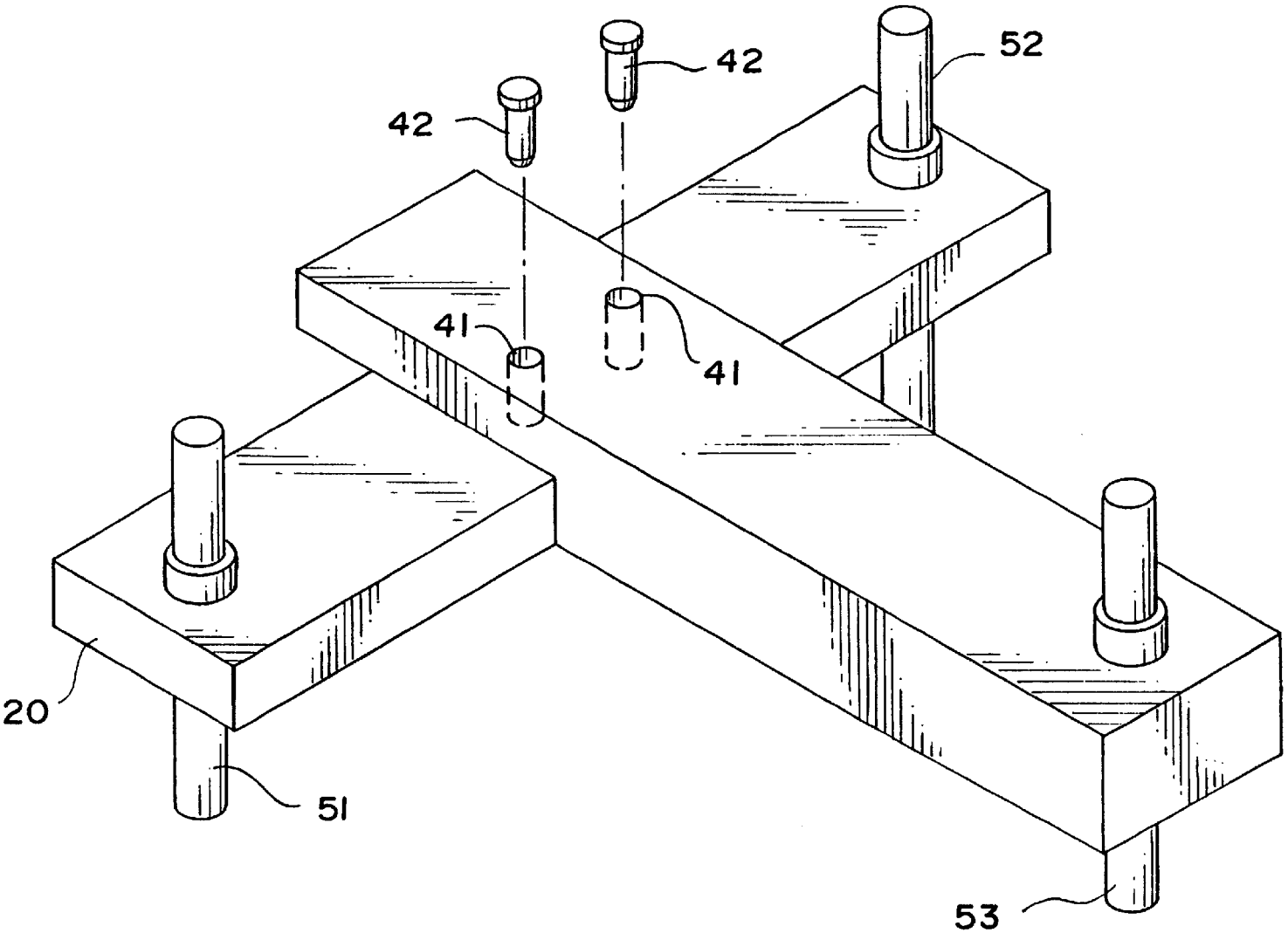
FIG. 15 is a perspective view of another embodiment of the present invention, wherein the hull components overlap and are connected by generally vertically-disposed couplings.

In yet another embodiment, one hull element merely overlaps the other hull element, with generally vertically-disposed coupling members connecting the two hull elements. FIG. 15 (which omits certain elements for clarity) shows hull component 30 in a simple overlapping relationship with hull component 20, with generally vertically disposed couplings joining the two hull components. FIG. 15 shows the male couplings 42 positioned to engage within female receptacles 41. In this embodiment, the lowermost hull component provides vertical support for the uppermost hull component, and the couplings prevent relative sliding movement therebetween. No keyway is present in this embodiment.

Figure 9A:
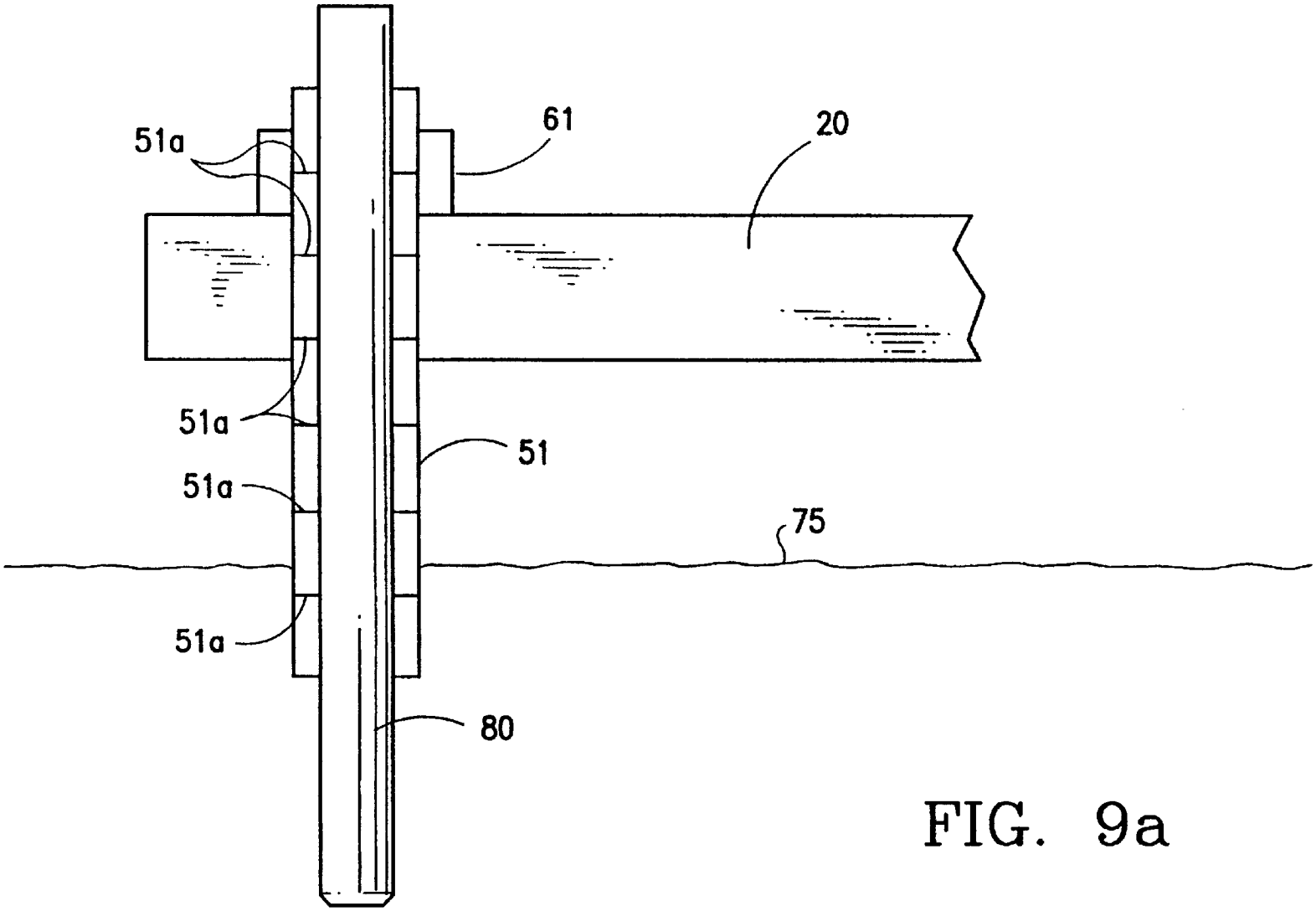
FIG. 9*a* is a side view in partial cross section, of an embodiment of the present invention having additional internal pilings driven through the jack-up legs.

It is understood that the embodiments of the present invention shown in FIGS. 10 through 15 may also comprise additional pilings driven into the sea floor through the legs, as shown in FIG. 9*a*.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

We claim:

1. A movable self-elevating work platform, comprising:

(a) a pair of buoyant hull components each of which:

i) is capable of independent buoyant navigation over water;

ii) has an elongated rectangular shape when viewed from above; and iii) has at least one leg slidably attached thereto, at least one of said hull components has at least 2 legs slidably attached thereto, said 2 legs disposed in a spaced apart relationship and substantially at either end of said hull, wherein until said pair of hulls are joined together, each of said hulls retains said elongated rectangular shape, each of said pair of buoyant hull components adapted so that one may be overlapped the other, and at least one coupling disposed between said pair of buoyant hull components when said pair of buoyant hull components are in a desired proximate and overlapping relationship, for coupling said buoyant hull components together to form a buoyant unitary work platform; and (b) a plurality of jacks attached to said unitary work platform and to each of said legs for raising and lowering said legs to the bed of a body of water upon which the unitary work platform is buoyantly disposed and for elevating and lowering said unitary work platform a desired distance above the surface of said body of water.

2. The movable self-elevating work platform of claim 1, wherein one of said pair of buoyant hull components comprises a keyway and a pair of guide members disposed adjacent said keyway, and the other of said pair of buoyant hull components comprises a male key element, said keyway and said guide members and said male key element having cross section shapes such that said male key element fits closely within said keyway and said guide members in an interlocking, overlapping relationship.

3. The movable self-elevating work platform of claim 2, wherein said pair of buoyant hull components are coupled together at substantially right angles, forming a "T" shaped work platform.

4. The movable self-elevating work platform of claim 2, further comprising a plurality of rails extending outwardly from said male key element and extending beyond said keyway.

5. The movable self-elevating work platform of claim 4, further comprising a drilling rig package comprising a derrick, a hoist, drilling fluid pumps and a rotary table, said drilling rig package mounted on said rails for movement back and forth thereon.

6. The movable self-elevating work platform of claim 1, wherein said buoyant hull components are comprised of a metal framework having a covering of water-tight metal sheeting, said metal framework further comprising a plurality of load bearing metal beams.

7. The movable self-elevating work platform of claim 6, wherein said at least one coupling is strongly attached to at least one of said plurality of load bearing beams.

8. The movable self-elevating work platform of claim 1, wherein each of said legs is disposed through a water-tight sleeved hull penetration passing through one of said buoyant hull components.

9. The movable self-elevating work platform of claim 2, wherein each of said legs is disposed through a water-tight sleeved hull penetration passing through one of said buoyant hull components.

10. The movable self-elevating work platform of claim 1, further comprising at least one flashing attached to said pair of hull components and spanning a space therebetween.

11. The movable self-elevating work platform of claim 10 wherein said at least one flashing is buoyant.

12. The movable self-elevating work platform of claim 11 wherein said at least one flashing has a vertical dimension substantially equal to a vertical dimension of said plurality of hull components.

13. The movable self-elevating work platform of claim 1, further comprising an internal piling disposed in at least one of said plurality of legs and driven into a water bottom to a desired depth.

* * * * *